United States Patent [19]

Schwarzkopf

[11] Patent Number: 4,622,455

[45] Date of Patent: Nov. 11, 1986

[54] CONNECTION ASSEMBLY FOR ELECTRIC CARTRIDGE HEATER

[75] Inventor: Eugen Schwarzkopf, Lüdenscheid, Fed. Rep. of Germany

[73] Assignee: Hotset Heizpatronen und Zubehor GmbH, Lüdenscheid, Fed. Rep. of Germany

[21] Appl. No.: 733,228

[22] Filed: May 10, 1985

[30] Foreign Application Priority Data

Jul. 24, 1984 [DE] Fed. Rep. of Germany ..... 3427207

[51] Int. Cl.[4] ..... H05B 3/08

[52] U.S. Cl. ..... 219/541; 219/523; 338/229

[58] Field of Search ..... 219/523, 541, 544; 338/214, 221, 229, 240, 241, 242, 243, 273, 274, 322, 326; 339/30, 61 R, 61 C, 88 R, 136 R, 89 R, 89 M, 95 R, 286 S, 90 R, 256 R, 90 C

[56] References Cited

U.S. PATENT DOCUMENTS

| | | | |
|---|---|---|---|
| 1,304,075 | 5/1919 | Lofgren | 339/90 R |
| 2,732,421 | 1/1956 | Chapman | 339/89 M X |
| 2,735,990 | 2/1956 | Gehlsen | 339/89 M X |
| 2,860,226 | 11/1958 | Williams et al. | 219/541 X |
| 2,961,632 | 11/1960 | Nachmeister et al. | 338/274 X |
| 3,040,284 | 6/1962 | Connell | 338/273 X |
| 3,124,405 | 3/1964 | Masser | 339/60 R |
| 3,167,736 | 1/1965 | Temple | 338/221 |
| 3,197,617 | 7/1965 | Gillespie et al. | 219/541 |
| 3,233,202 | 2/1966 | Kyle | 219/541 X |
| 3,803,532 | 4/1974 | Taxon | 339/88 R |

FOREIGN PATENT DOCUMENTS

| | | | |
|---|---|---|---|
| 478161 | 1/1938 | United Kingdom | 338/240 |

*Primary Examiner*—E. A. Goldberg
*Assistant Examiner*—M. M. Lateef
*Attorney, Agent, or Firm*—Karl F. Ross; Herbert Dubno

[57] ABSTRACT

A heating-cartridge assembly has a shell, a first rigid insulating body in the shell having a longitudinally directed end face, a heating conductor imbedded in the body and having a pair of ends, and respective highly conductive and stiff wires imbedded in the body, connected to the ends, and having uninsulated wire ends spaced transversely from each other and projecting longitudinally from the face of the body. A second rigid insulating body independent of the first body and having a respective face is provided with a pair of imbedded and highly conductive tubular sockets having outer ends exposed at the second-body face and inner ends and lying parallel to each other at the same transverse spacing as the projecting uninsulated wire ends. These projecting stiff wires are complementarily and snugly engageable in the tubular sockets with the faces of the two insulating bodies abutting longitudinally. Respective feed conductors are connected to the inner ends of the tubular sockets.

13 Claims, 4 Drawing Figures

CONNECTION ASSEMBLY FOR ELECTRIC CARTRIDGE HEATER

FIELD OF THE INVENTION

The present invention relates to an electric cartridge heater. More particularly this invention concerns a connection assembly for such a heater.

BACKGROUND OF THE INVENTION

A heating-cartridge normally has a generally cylindrical metallic shell, a rigid insulating body in the shell having a longitudinally directed end face, and a heating conductor imbedded in the body and having a pair of ends. This heating wire is normally of the resistive type that is formed into a coil between its ends. Respective highly conductive wires imbedded in the body are connected to the ends and have insulated portions that project from the face of the body.

Such a heating cartridge is mounted in a blind bore of a piece of process equipment as described in copending application 426,100 filed Sept. 28, 1982 (now abandoned), typically a machine used in molding thermoplastic synthetic resins. Its wires extend to a termlnal board where they are connected to feed conductors or terminals.

As such a heating device is subjected to considerable thermal stress, it has a limited service life. Replacement is an onerous task involving disconnecting the wires and pulling out the nonworking cartridge, then inserting a new cartridge and connecting up its conductors.

OBJECTS OF THE INVENTION

It is therefore an object of the present invention to provide an improved heating-cartridge assembly.

Another object is the provision of such a heating-cartridge assembly which overcomes the above-given disadvantages, that is which is relatively easy to service and replace.

SUMMARY OF THE INVENTION

A heating-cartridge assembly according to the invention has a shell, a first rigid insulating body in the shell having a longitudinally directed end face, a heating conductor imbedded in the body and having a pair of ends, and respective highly conductive and stiff wires imbedded in the body, connected to the ends, and having uninsulated wire ends spaced transversely from each other and projecting longitudinally from the face of the body. A second rigid insulating body independent of the first body and having a respective face is provided with a pair of imbedded and highly conductive tubular sockets having outer ends exposed at the second-body face and inner ends and lying parallel to each other at the same transverse spacing as the projecting uninsulated wire ends. The projecting stiff wires are complementarily and snugly engageable in the tubular sockets with the faces of the two insulating bodies abutting longitudinally. Respective feed conductors are connected to the inner ends of the tubular sockets.

Thus with the system of this invention the plug unit at the ends of the feed conductors can be pulled off a nonworking cartridge heater which can then be removed and replaced. The plug unit is then pushed onto the new cartridge, and the system is repaired. The cartridge itself can be a somewhat cheaper unit than hitherto, since the short prongs formed by the projecting ends of the stiff wires are cheaper to manufacture than long leads.

According to a feature of this invention a conductive and tubular second shell tightly receives the second body and projects therefrom longitudinally past the faces to fit snugly around the shell of the first body in good electrical contact when the projecting ends are fitted in the sockets and the two faces are abutting. The shell of the second body is provided with a connection for a ground line.

According to another feature of this invention the second insulating body has a back face directed longitudinally opposite to its front face and the assembly also has a silicone plug in the shell engaging against the back face of the second body. The feed conductors extend out of the back face and through the silicone plug in which they are imbedded.

Furthermore in accordance with the invention the second shell is formed with inward projections engaging transversely in the second body and securing same against longitudinal displacement in the second shell. This construction makes the assembly very solid and ensures a hermetic dusttight fit between its parts.

The second shell can be formed longitudinally beyond the face of the second body with a slot to engage snugly around the first shell. It is also possible for the shells to be formed with a bump and a recess engaged thereby to lock the two shells together in which case the shells are sufficiently elastically deformable to allow transverse disengagement of the bump and recess for fitting together and taking apart the assembly. Thus the two parts can be snapped snugly together, resisting separation when vibrated.

It is also within the scope of this invention for the second body to be able to swivel in the second shell about a longitudinal axis and the two shells to be formed with complementary and interfittable screwthread formations. Specifically the screwthread formations include an external thread on the first shell and an internal thread on the second shell. This allows them to be very solidly and hermetically connected.

In another arrangement in accordance with this invention one of the shells is formed with an L-shaped slot or groove and the other with a bump or pin engaging therein to form a bayonet coupling. In this case the second body is swivelable in the second shell about a longitudinal axis.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
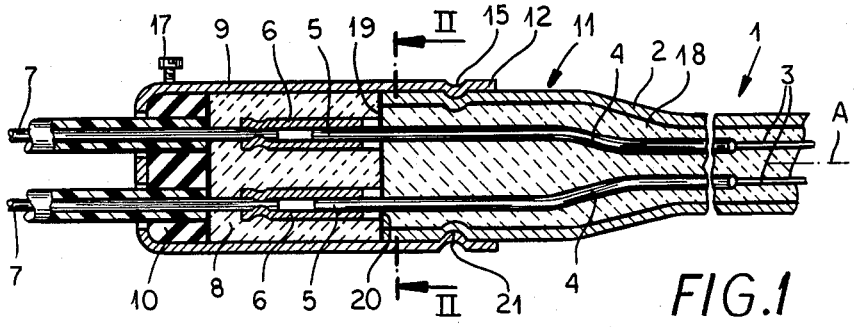
FIG. 1 is a longitudinal axial section through the end of a heating cartridge and its connection assembly according to this invention.
Figure 2:
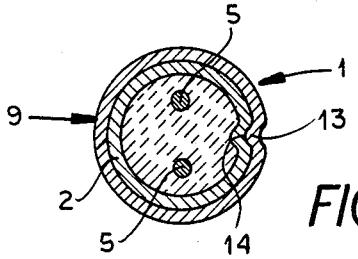
FIG. 2 is a cross section taken along line II—II of FIG. 1.

As seen in FIGS. 1 and 2 a heating cartridge 1 has a tubular stainless-steel shell 2 within which a resistive heating element or wire 3 is imbedded in a rugged ceramic body 18. This cartridge 1 has a large-diameter end 11 with an end face 19 and in this end the ends of the wire 3 are connected to respective uninsulated but highly conductive and rigid wires 4 having ends 5 projecting from the face 19 parallel to the axis A of the assembly.

Another shell 9 contains another ceramic body 8 having a transverse front face 20 and in which are embedded two highly conductive metallic tubes or sockets 6 that are exposed but slightly recessed behind the face 20. In addition these tubular sockets 6 extend parallel to the longitudinal axis A, are at the same transverse diametral spacing as the ends 5, and are of an inside diameter equal to the outside diameter of these ends 5 so they can be snugly received for good conducting of electricity.

The rear ends of the tubular sockets 6 are crimped onto the stripped ends of otherwise insulated feed wires 7. A silicone plug 10 in the shell 9 behind the ceramic body 8 snugly surrounds these wires 7 to anchor them solidly and hermetically in the shell 9 whose rear end is closed and formed with two holes for the wires 7.

The shell 9 has a front end 12 that projects longitudinally forward past the face 20 through a longitudinal distance substantially greater than the axial projection of the ends 5 from the face 19 and that is formed both with a circumferential inwardly projecting ridge 15 that fits with a corresponding outwardly open groove 21 formed in the shell 2 and with a longitudinal inwardly projecting ridge 13 that fits with a corresponding outwardly open groove 14 formed in the shell 2. The formations 13 and 14 angularly orient the prongs or ends 5 with the sockets 6, and the formations 15 and 21 hold the two shells 2 and 9 hermetically together, while providing a good ground path to a ground lug 17 provided on the shell 9.

Figure 3:
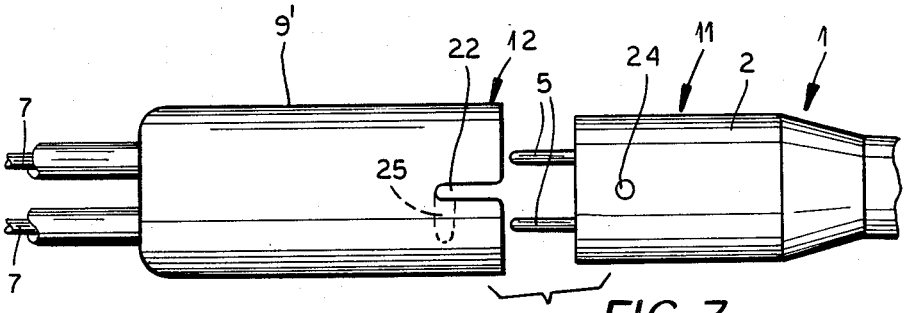
FIG. 3 is a transverse side view of another assembly in accordance with this invention.

FIG. 3 shows another arrangement wherein the shell 9' is formed with a forwardly open split 22 so that the end 12 can spread and engage tightly around the end 11 of the sleeve 2. This split can be extended as indicated at 25 to engage a pin 24 on the shell 2, forming a bayonet coupling.

Figure 4:
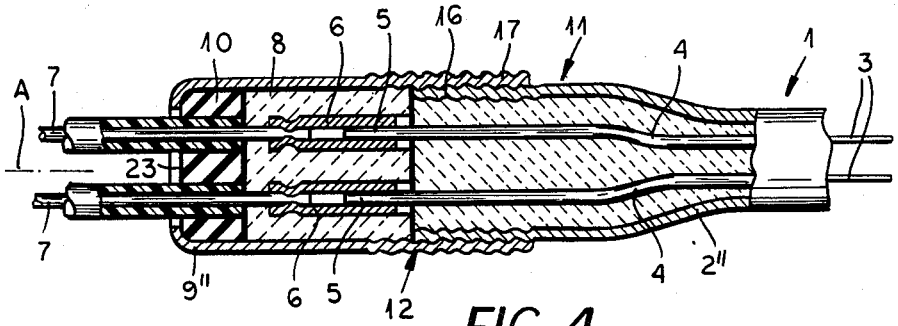
FIG. 4 is a view like FIG. 1 of a further assembly according to the invention.

In FIG. 4 the rear end of the sleeve 9'' is formed like the sleeve 9' with a single large-diameter hole 23 through which the two insulated wires 7 project. In addition as in FIG. 3 the plug 10 and body 8 are only fixed longitudinally in the sleeve 9'', but can rotate about the axis A therein. In addition the front end 12 of the sleeve 9'' is deformed to have an inner thread 17 that fits over a similarly formed outer thread 16 on the end 11 of the sleeve 2''. Thus the prongs 5 can be inserted into the tubes 6 and then the two sleeves 2'' and 9'' can be screwed together to solidly make the ground connection between them.

It is therefore possible for the heater 1 to be disconnected fairly simply. The use of ceramic for the bodies 8 and 18 allows the assembly to resist high temperatures and the tight interfit of the two shells 2 and 9 prevents dust and the like from getting into and contaminating the electrical connection.

I claim:

1. A heating-cartridge assembly comprising an electrically conductive first shell;

a first rigid and electrically insulating body in the shell having a longitudinally directed end face;

an electrical heating conductor imbedded in the body and having a pair of ends;

respective highly electrically conductive and stiff wires imbedded in the body, connected to the ends, and having uninsulated wire ends spaced transversely from each other and projecting longitudinally from the face of the body;

a second rigid electrically insulating and ceramic body independent of the first body and having a respective face;

a pair of highly electrically conductive tubular sockets imbedded in the second body, having outer ends exposed at the second-body face and inner ends, and lying parallel to each other at the same transverse spacing as the projecting uninsulated wire ends, these projecting stiff wires being complementarily and snugly engageable in the tubular sockets with the faces of the two insulating bodies abutting longitudinally;

respective electrical feed conductors connected to the inner ends of the tubular sockets; and an electrically conductive and tubular second shell tightly receiving the second body and projecting therefrom longitudinally past the faces and fitting in good electrical contact snugly around the first shell when the projecting ends are fitted in the sockets and the two faces are abutting.

2. The heating-cartridge assembly defined in claim 1 wherein the tubular sockets are fixedly bedded in the second body, and are unsplit and circumferentially continuous.

3. The heating-cartridge assembly defined in claim 1 wherein the shell of the second body is provided with a connection for a ground line.

4. The heating-cartridge assembly defined in claim 1 wherein the second insulating body has a back face directed longitudinally opposite to its front face, the assembly further comprising a silicone plug in the shell engaging against the back face of the second body, the feed conductors extending out of the back face and through the silicone plug in which they are imbedded.

5. The heating-cartridge assembly defined in claim 1 wherein the second shell is formed with inward projections engaging transversely in the second body and securing same against longitudinal displacement in the second shell.

6. The heating-cartridge assembly defined in claim 1 wherein the second shell is formed longitudinally beyond the face of the second body with a slot and engages snugly around the first shell.

7. The heating-cartridge assembly defined in claim 1 wherein the shells are formed with a bump and a recess engaged thereby to lock the two shells together, the shells being sufficiently elastically deformable to allow transverse disengagement of the bump and recess for fitting together and taking apart the assembly.

8. The heating-cartridge assembly defined in claim 1 wherein the second body can swivel in the second shell about a longitudinal axis and the two shells are formed with complementary and interfittable screwthread formations.

9. The heating-cartridge assembly defined in claim 8 wherein the screwthread formations include an external thread on the first shell and an internal thread on the second shell.

10. The heating-cartridge assembly defined in claim 1 wherein the shells are provided with an interfitting bayonet coupling, the second body being swivelable in the second shell about a longitudinal axis.

11. The heating-cartridge assembly defined in claim 1 wherein the bodies have enlarged ends forming the respective faces.

12. The heating-cartridge assembly defined in claim 1 wherein the bodies are force-fitted in the respective shells.

13. A heating-cartridge assembly comprising a first electrically conductive metal shell;

a first ceramic boby in the first shell having a longitudinally directed and flat end face;

an electrical heating conductor imbedded in the first ceramic body and having a pair of ends;

respective highly electrically conductive and stiff wires imbedded in the first ceramic body, connected to the heating-conductor ends, and having uninsulated wire ends spaced transversely from each other and projecting longitudinally from the face of the body:

a second ceramic body independent of the first body and having a respective flat end face;

a pair of highly electrically conductive tubular sockets imbedded in the second body, having outer ends exposed at the second-body face and inner ends, and lying parallel to each other at the same transverse spacing as the projecting uninsulated wire ends, these projecting stiff wires being complementarily and snugly engageable in the tubular sockets with the faces of the two insulating bodies abutting longitudinally flatly;

respective electrical feed conductors connected to the inner ends of the tubular sockets; and a second electrically conductive metal shell receiving the second body and projecting therefrom longitudinally past the faces and fitting snugly around the first shell in good electrical contact therewith when the projecting ends are fitted in the sockets and the two faces are abutting.

* * * * *